US005775626A

United States Patent [19]

Ono et al.

[11] Patent Number: 5,775,626

[45] Date of Patent: Jul. 7, 1998

[54] APPARATUS AND METHOD FOR WINDING WIRE AROUND A WORKPIECE

[75] Inventors: Akira Ono; Hiroyuki Takubo, both of Kanagawa; Hideaki Kawaura, Chiba, all of Japan

[73] Assignee: Sony Corporation, Japan

[21] Appl. No.: 719,443

[22] Filed: Sep. 25, 1996

[30] Foreign Application Priority Data

Sep. 29, 1995 [JP] Japan ..... 7-276857

[51] Int. Cl.[6] ..... B21F 3/10; B65H 81/06; H01F 41/06

[52] U.S. Cl. ..... 242/437; 242/440.1; 29/605

[58] Field of Search ..... 242/437, 440, 242/439, 440.1; 29/605

[56] References Cited

U.S. PATENT DOCUMENTS

| | | | |
|---|---|---|---|
| 4,078,301 | 3/1978 | Renders et al. | 29/605 |
| 4,121,627 | 10/1978 | Schmid | 242/440 X |
| 4,217,937 | 8/1980 | Ache et al. | 242/437 X |
| 5,088,186 | 2/1992 | Boesel | 29/605 |
| 5,191,307 | 3/1993 | Hashimoto et al. . | |
| 5,373,274 | 12/1994 | Belica et al. | 29/605 X |
| 5,419,503 | 5/1995 | Watanabe et al. . | |
| 5,622,331 | 4/1997 | Kosaka et al. | 242/440.1 X |

FOREIGN PATENT DOCUMENTS

| | | |
|---|---|---|
| 0582409A1 | 2/1994 | European Pat. Off. . |
| 0596628A2 | 5/1994 | European Pat. Off. . |
| 7-50 846 A | 2/1995 | Japan . |

OTHER PUBLICATIONS

IBM Technical Disclosure Bulletin, vol. 33, No. 9, pp. 165–166, Feb. 1991.

*Primary Examiner*—Donald P. Walsh
*Assistant Examiner*—Emmanuel M. Marcelo
*Attorney, Agent, or Firm*—Ronald P. Kananen

[57] ABSTRACT

An apparatus which includes a nozzle unit, a guide unit, a first winding assemblage and a second winding assemblage, operates such that the first winding assemblage forms a first winding (e.g., a deflection coil on a deflection yoke for use with a cathode ray tube) by moving the wire material from the nozzle unit in a three-dimensional direction after binding the wire material to the workpiece through the guide unit cooperating with the nozzle unit and the second winding assemblage forms a second winding (e.g., a leakage magnetic field shielding coil) different from the first winding by moving the nozzle unit in directions parallel and normal to the axis of the workpiece, respectively. Unlike the conventional apparatus, it is possible to wind a wire material in a variety of ways in different directions while keeping the position of the workpiece in a certain posture.

6 Claims, 8 Drawing Sheets

APPARATUS AND METHOD FOR WINDING WIRE AROUND A WORKPIECE

BACKGROUND OF THE INVENTION

The present invention relates to a winding apparatus for winding a wire material around a workpiece and more particularly to a winding apparatus and method for forming a deflection coil and a leakage magnetic field shielding coil with respect to, for example, a deflection yoke as a workpiece.

The deflection yoke as used for a cathode ray tube such as a TV receiver requires a leakage magnetic field shielding coil (VLF) for shielding a leakage magnetic field due to electron beams and a deflection coil for deflecting the electron beams.

Recently, in performing a winding operation with respect to a deflection yoke, there has been a strong demand for integrally performing the VLF coil winding and the deflection coil winding by a single winding apparatus. This is because of a demand for saving power in the deflection yoke coil winding operation.

However, it is considered difficult to perform the VLF winding and the deflection coil winding integrally with each other by a single winding apparatus. Generally, for forming a VLF winding, a method of winding the wire material around the deflection yoke by a dedicated machine while keeping the deflection yoke horizontal.

If it is attempted to perform both a VLF winding and a deflection coil winding integrally by a single winding apparatus, a mere combination of a conventional VLF winding apparatus and a conventional deflection coil winding apparatus is complicated in structure such that for example, where the deflection coil winding operation shifts to the VLF winding operation or vice versa, it becomes necessary to change the attitude of the deflecting yoke, for example, from its vertically oriented state to its horizontally oriented state which results in increasing the number of manhours.

Conventionally, the winding apparatus for such deflecting yoke is disclosed in U.S. Pat. Nos. 5,484,113 and 5,419,503. The nozzles used in these prior art techniques make use of rollers or guide members in order to guide an introduced wire material vertically, upper right or left or lower right or left.

However, by mere use of such rollers or guide members for the nozzle, it is difficult to perform a VLF winding and a deflection coil winding altogether because the wire material introduced from the nozzle can not be guided well to come close to the grooves formed in various minor portions of the deflecting yoke.

SUMMARY OF THE INVENTION

The present invention has been made to eliminate the above-described problems and an object of the present invention is to provide a winding apparatus which is capable of winding a wire material in a variety of ways in different directions while keeping a workpiece such as a deflecting yoke in a certain attitude, and also to provide a winding method using the apparatus.

The above-described object of the present invention can be achieved by using a winding apparatus which comprises: a nozzle unit for supplying a wire material from a wire material supply source to a workpiece; first winding means for forming a first winding by moving the wire material from the nozzle unit in a three-dimensional direction after binding the wire material around a binding portion of the workpiece through a guide unit cooperating with the movement of the nozzle unit; and second winding means for forming on the workpiece a second winding different from the first winding by moving the nozzle unit in directions parallel and normal to the axis of the workpiece, respectively.

In the present invention, where the wire material from the wire supply source is wound around the workpiece, the first winding means can form the first winding on the workpiece by binding the wire material from the nozzle unit at the binding portion of the workpiece and then moving it in three-dimensional directions through the cooperation of the nozzle unit and the guide unit.

Further, the second winding means can form the second winding different from the first winding by moving the nozzle unit in directions parallel and normal to the axis of the workpiece, respectively.

Where the workpiece is, for example, the frame of the deflecting coil for a cathode ray tube, the first winding corresponds to a deflecting coil and the second winding corresponds to a leakage magnetic field shielding coil. Further, where the first and second windings are formed, it is not necessary to change the attitude of the workpiece.

In the present invention, the top end of the nozzle unit from which the wire material is introduced is substantially L-shaped with a projection of a size so set as to allow the nozzle to pass along every part of the workpiece. By such arrangement, the top end of the nozzle unit can enter into the minor portions such as grooves, of every part of the workpiece so that the first and second windings can be secured to the corresponding parts of the workpiece, respectively.

The above-described object of the present invention can be achieved by a winding method for winding a wire material paid out from a wire material supply source, which method is characterized in that a first winding is formed on the workpiece in such a manner that the wire material from the wire material supply source is fed to the workpiece through a nozzle unit and after being bound up around a binding portion of the workpiece, it is moved in a three-dimensional direction through a guide unit cooperating with the movement of the nozzle unit, and a second winding different from the first winding is formed on the workpiece by moving the nozzle unit in directions parallel and normal to the axis of the workpiece.

The above-described object of the present invention can be achieved by a winding method for winding a wire material paid out from a wire material supply source, which method is characterized in that a second winding is formed on the workpiece by moving a nozzle unit, through which the wire material is fed to the workpiece, in directions parallel and normal to the axis of the workpiece and a first winding different from the second winding is formed on the workpiece in such a manner that the wire material from the nozzle unit is moved in a three-dimensional direction after it is bound up around a binding portion of the workpiece by the nozzle unit and a guide unit cooperating with the movement of the nozzle unit.

PREFERRED EMBODIMENTS OF THE INVENTION

Preferred embodiments of the present invention will now be described with reference to the accompanying drawings.

It should be noted that although the following embodiments include various kinds of technically preferable limitations since they are practically preferred examples of the present invention, the present invention is not always limited to these examples unless specifically described otherwise in the following description.

Figure 1:
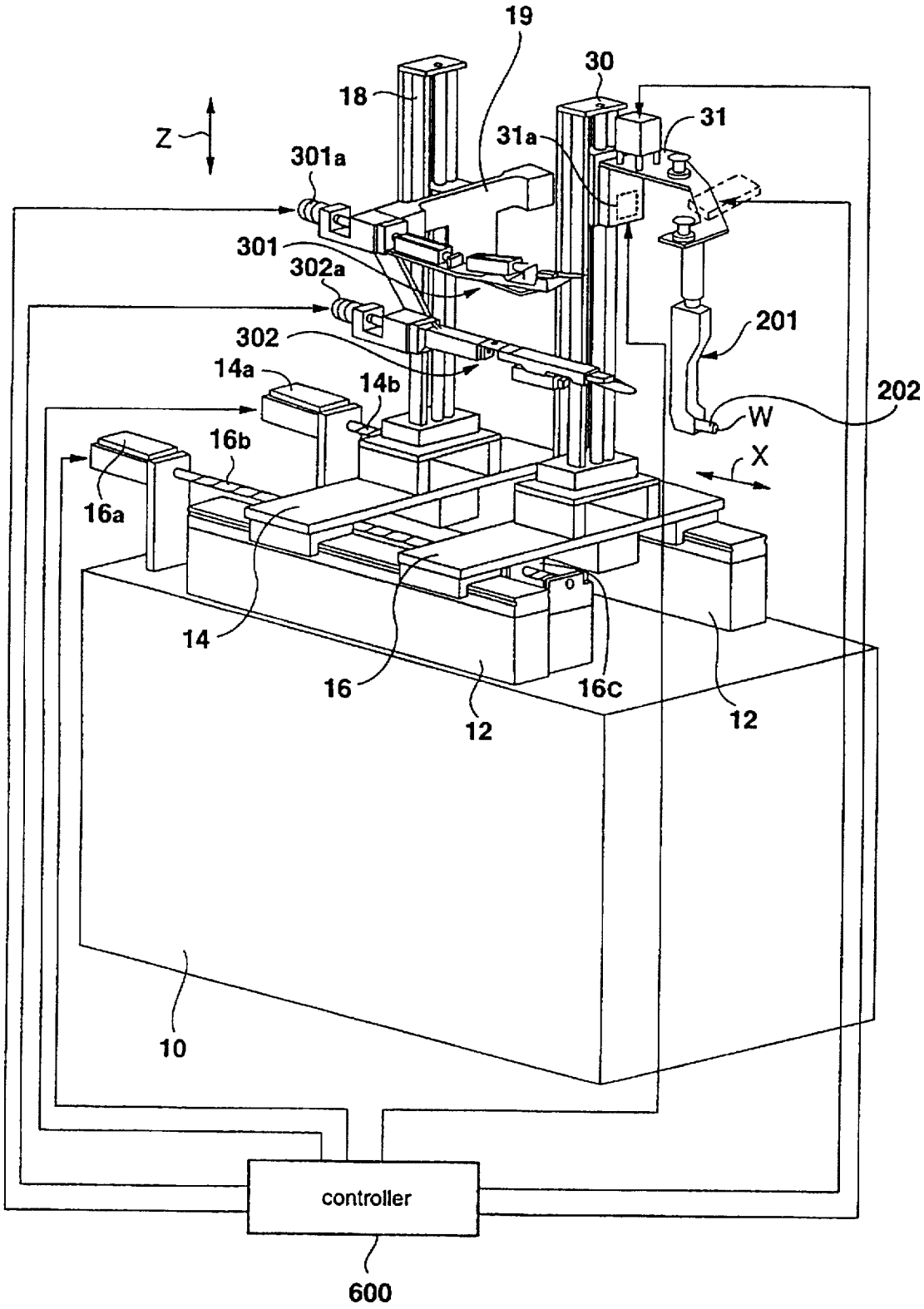
FIG. 1 is a perspective view of a winding apparatus in its entireties according to one embodiment of the present invention.

FIG. 1 which is a perspective view of a winding apparatus in its entireties according to a preferred embodiment of the present invention. As shown, guide rails 12, 12 are fixed to a base 10 of a winding apparatus. These guide rails 12, 12 are fixed to a base 10 of a winding apparatus. These guide rails 12, 12 movably support a guide unit carrier 14 and a nozzle unit carrier 16 in the direction of the arrow X.

The guide unit carrier 14 can be moved and positioned in the direction of the arrow X by rotating a feed screw 14*b* through the operation of a motor 14*a*. Further, the nozzle unit carrier 16 can be moved and positioned by rotating a feed screw 16*b* through the operation of a motor 16*a*. The feed screw 16*b* engages a nut portion 16*c* of the nozzle unit carrier 16 with both of the feed screw 16*b* and the nut portion 16*c* being shown enlarged.

The guide unit carrier 14 is provided with a strut 18 whose drive section (not shown) can move and position a support member 19 in the direction of the arrow Z (vertical direction). The support member 19 is provided with an upper guide unit 301 and a lower guide unit 302 which are arranged parallel with each other in substantially the horizontal direction.

Figure 2:
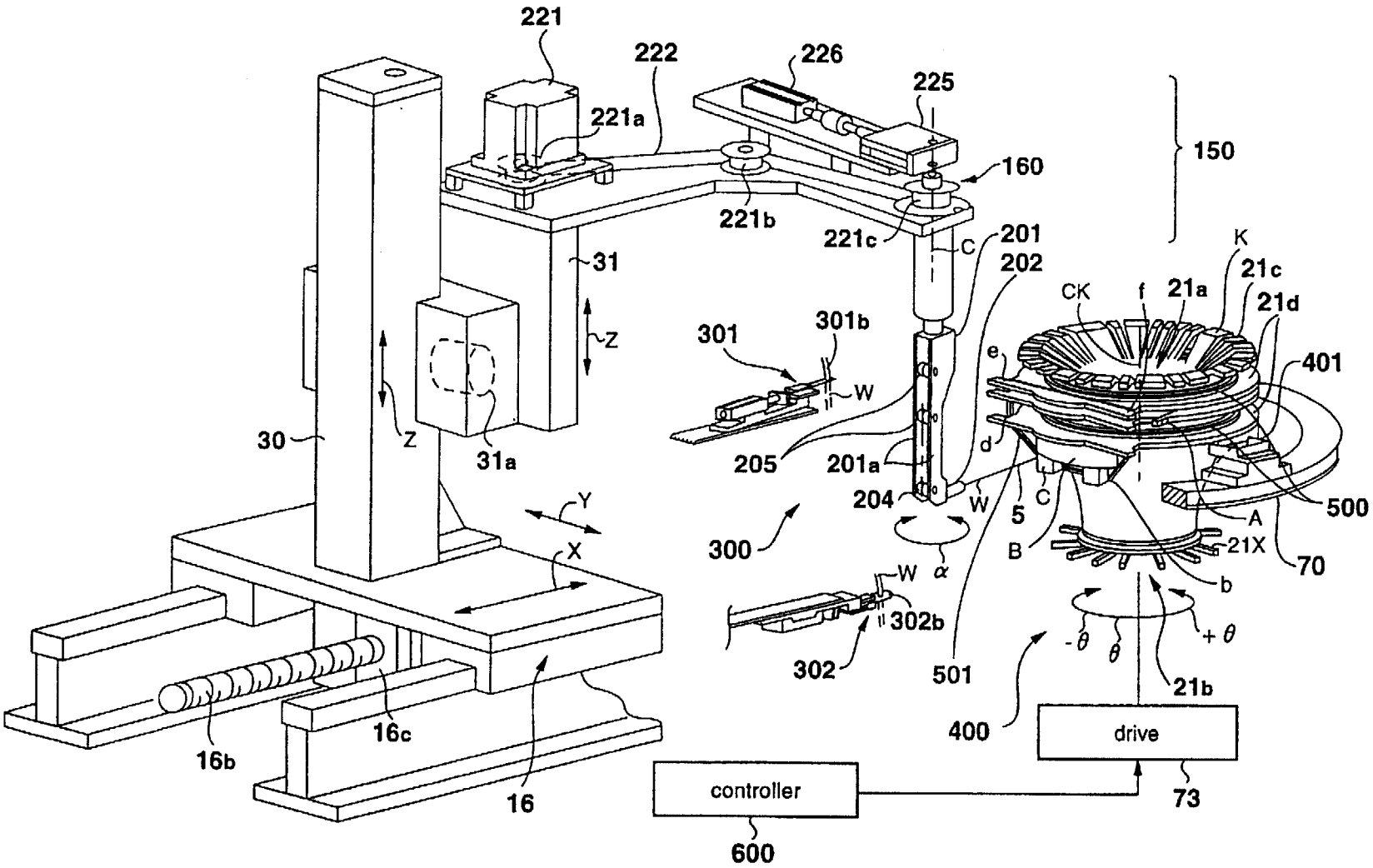
FIG. 2 is a perspective view showing a nozzle unit carrier, a mechanical portions around a nozzle unit of the wiring apparatus of FIG. 1, a workpiece and a workpiece support.

The upper guide unit 301 is provided with an actuator 301*a* through the operation of which a hook 301*b* shown in FIG. 2 removably holds the wire material W in a sandwiching manner. Similarly, the lower guide unit 302 of FIG. 1 is provided with an actuator 302*a* through the operation of which a hook 302*b* shown in FIG. 2 can hold the wire material W in a sandwiching manner.

Next, the nozzle unit carrier 16 of FIG. 1 is provided with a strut 30. The strut 30 is provided with a nozzle unit support section 31 which can be positioned and moved in the direction of the arrow Z by a drive section 31*a* comprising a motor. As shown in FIG. 2, the nozzle unit support section 31 is provided with a drive motor 221, a belt 222, a wire material stopper 225 and a nozzle unit 201.

Around a pulley 221*a*, a pulley 221*b* and a pulley 221*c* of the drive motor 221 there is passed a belt 222. By operating the drive motor 221, the nozzle unit 201 can be indexed by a predetermined angle in a direction of α around an axis C. The wire material stopper 225 has the function of stopping the supply of the wire material W toward the nozzle unit 201 by the operation of an actuator 226.

Next, the nozzle unit 201 will be described.

Figure 3:
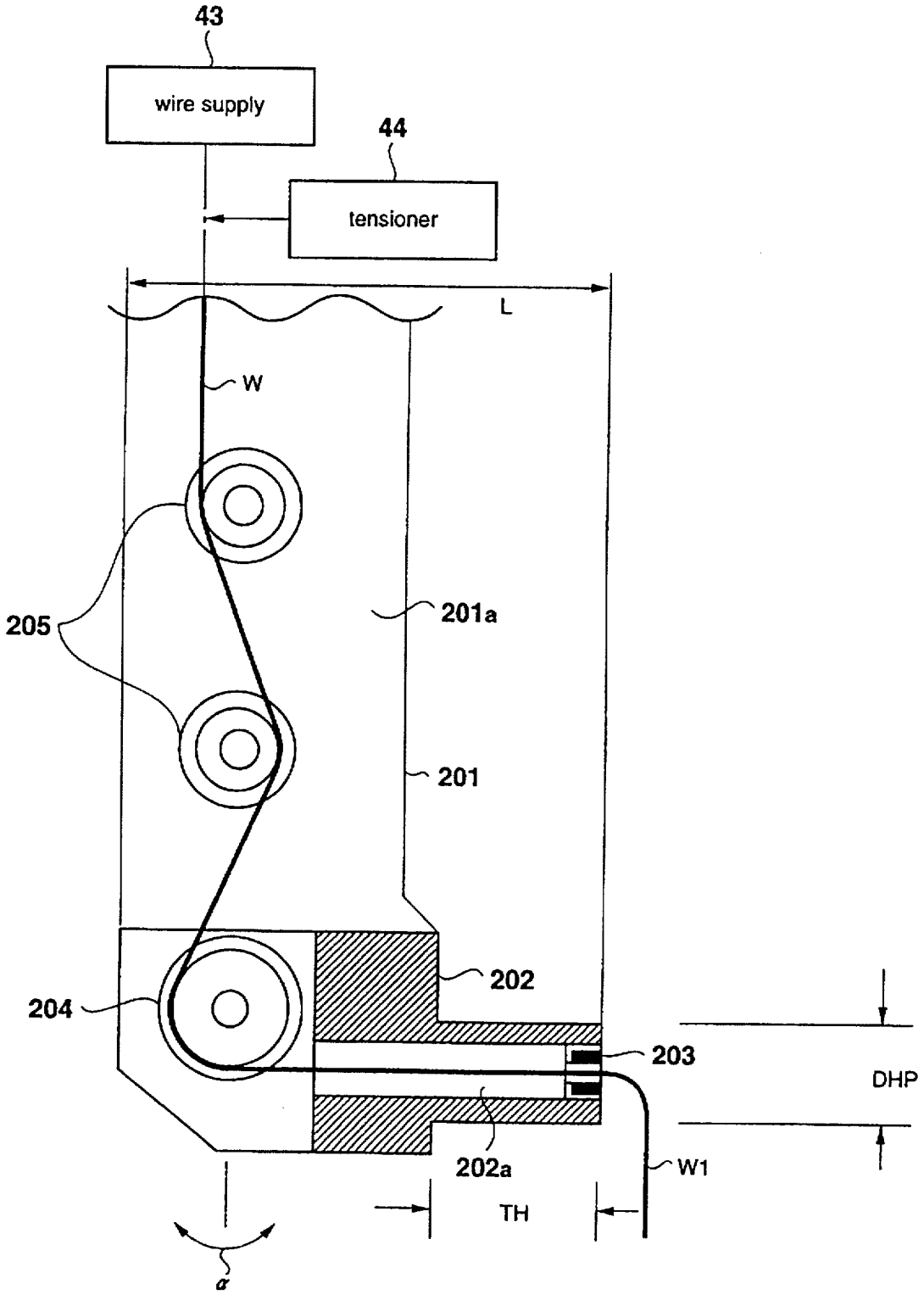
FIG. 3 is a view showing an essential portion of the nozzle unit.

As shown in FIGS. 2 and 3, the nozzle unit 201 can be indexed in the direction of the arrow α as described above. The nozzle unit 201 is provided with side plates 201*a*, 201*a* between which three guide rollers 205, 205 and 204, a top end member 202 and a guide member 203 for leading out the wire material W are arranged.

The two guide rollers 205, 205 are rotatably provided between the side plates 201*a*, 201*a*. The remaining guide roller 204 is rotatably provided on the side of the top end member 202.

The top end member 202 corresponds to the top end of the nozzle unit 201 and is provided with a passage 202*a* for allowing the wire material W to pass therethrough and at the end of the passage 202*a* there is provided a guide member 203. The guide member 203 is made of an abrasion-resistant material, for example, ruby or ceramics so as to serve as a guide member for leading out the wire material W.

The top end member 202 projects in the horizontal direction and is substantially in the form of a lateral convex cylinder. Accordingly, the nozzle unit 201 has the top end member 202 so that it is, as a whole, in the shape of L. The lateral width L of the nozzle unit 201 is smaller than the inner diameter of an opening 21*b* of the workpiece K shown in FIG. 2.

In addition, the projecting length TH of the guide member 203 is such that the guide member 203 can enter every minor portion of a VLF winding portion B of the workpiece K of FIG. 2 and the diameter DHP of the guide member 203 can also enter every minor portion of the VLF winding portion B.

The wire material W is introduced outside from the guide member 203 through the passage 202*a* via the guide rollers 205, 205 and the guide roller 204 as shown in FIG. 3. The wire material W is led out from the wire material supply source 43 and the intermediate portion of the wire material is applied with a predetermined tension by a tensioner 44.

A workpiece support 70 shown in FIG. 2 is provided with a work receiving plate 401 which is a portion supporting the workpiece K in a stabilized state. The workpiece K is supported on the receiving plate 401 with the central axis CK thereof extending in the vertical direction. The workpiece support 70 can be indexed by a predetermined angle in the direction of the arrow ϕ by the operation of a rotary section 73.

In the instant embodiment, the workpiece K is the frame of a deflecting yoke provided in the cathode ray tube of a TV receiver and it has the following structure.

That is, the workpiece K of FIG. 2 is, for example, a high vision deflecting yoke and is substantially funnel-shaped. When the workpiece K is mounted on the cathode ray tube, the opening 21*a* of the workpiece K is positioned on the fluorescent surface of the cathode ray tube and the smaller opening 21*b* is arranged on the side of the neck of the cathode ray tube.

The workpiece K is provided with a plurality of engagement strips 21*c* and a plurality of winding grooves 21*d*. Further, the smaller opening 21*b* is provided with engagement strips 21*x*. These engagement strips 21*c*, winding grooves 21*d* and engagement strips 21*x* are portions around which a deflection coil is wound.

The workpiece K is provided with a winding portion B corresponding to a portion where a leakage magnetic field shielding coil (VLF) is formed in the vicinity of the winding grooves 21*d*.

A main body supply portion 150 is constructed of the wire material stopper 225, the rotary drive section 160 and the nozzle unit 201. The rotary drive section 160 is constructed of the above-mentioned drive motor 221, the belt 222, the pulleys 221*a*, 221*b* and 221*c*.

Further, a first winding means 300 shown in FIG. 2 is the portion where the winding in the first direction is formed by moving the wire material W in a three-dimensional direction after binding the wire material W about the binding portions of the workpiece K corresponding to the engagement strips 21*c* and 21*x* by the nozzle unit 201 for supplying the wire material W from the wire material supply source 43 of FIG. 2 to the workpiece K, the upper guide unit 301 cooperating with the movement of the nozzle unit 201. This first winding is the above-described deflection coil.

Further, a second winding means 400 is the portion where a second winding different from the first winding is formed on the workpiece K by moving the nozzle unit 201 in directions parallel and normal to the axis CK of the workpiece K. This second winding is the leakage magnetic field shielding coil (VLF). Further, the first winding means 300 is constructed of the nozzle unit 201, the upper guide unit 301, the lower guide unit 302 and the workpiece support 70. Further, the second winding means 400 is constructed of the nozzle unit 201 and the workpiece support 70.

A control section 600 controls the actuators 301*a*, 302*a*, the drive section 31*a*, the drive motor 221, the motors 14*a*, 16*b*, the actuator 226 and the operation of the rotary section 73 of FIG. 2.

Next, a method of forming a deflection coil 450 and a leakage magnetic field shielding coil 501 of the workpiece K as the deflection yoke of FIG. 2 by using the above-described winding apparatus will be described.

Deflection Coil Winding Operation

First, one example of forming the deflection coil on the workpiece K will be described.

This deflection coil is the first winding 450 which is applied on the workpiece K by using the first winding means 300.

The wire material W of FIG. 3 is applied with a predetermined tensile force by a tensioner 44 lest the wire material W should become loosened while it is fed from the wire material supply source. Then, the wire material W runs along the path 202*a* via the guide rollers 205, 205 and 204 of the nozzle unit 201 and is led outside from the guide member 203. The wire material W is directed substantially L-shaped at the guide roller 204 and is led out horizontally from the guide member 203.

Figure 4:
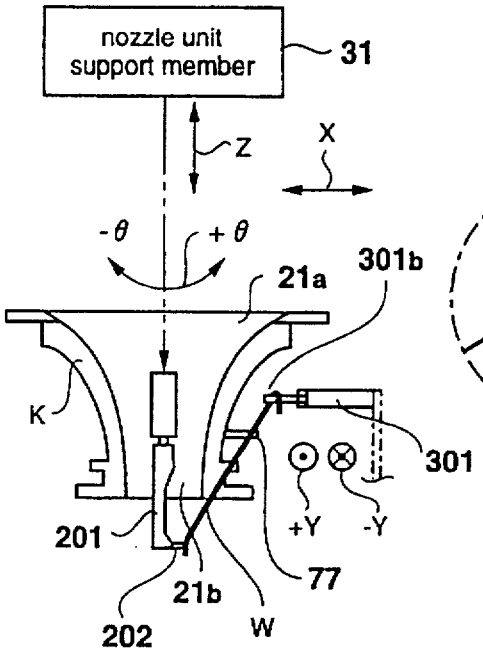
FIG. 4 is a diagram showing an initial operation of winding a horizontal deflection coil.
Figure 4A:
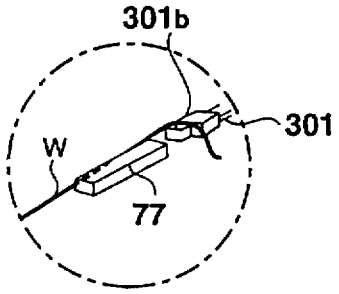

The top end W1 of the wire material W is fixedly bound around a pin 77 of FIG. 4. That is, when the nozzle unit support section lowers the nozzle unit 201 toward a Z-direction as designated by an arrow, the nozzle unit 201 goes along the opening 21*b* from the opening 21*a* of the workpiece K. Then the hook 301*b* of the upper guide unit fixes the top end of the wire material W in a sandwiching fashion. Then the wire material W is guided toward the rear side of the binding pin 77 and in this stage, the workpiece support 70 is indexed by a predetermined angle in the direction of +θ by the operation of the rotary section 73 whereby the upper guide unit 301 is deemed to have been relatively moved in the direction of +Y of FIG. 4. After that, the guide unit 301 is moved in the Z-direction to cause the workpiece support 70 of FIG. 2 to be indexed again by a predetermined angle in the direction of −θ whereby the upper guide unit 301 is deemed to have been relatively moved in the −Y direction. Thus, the wire material W held by the upper guide unit 301 is bound around the binding pin 77. The binding of the wire material W around the pin 77 is performed a plurality of times.

Figure 5:
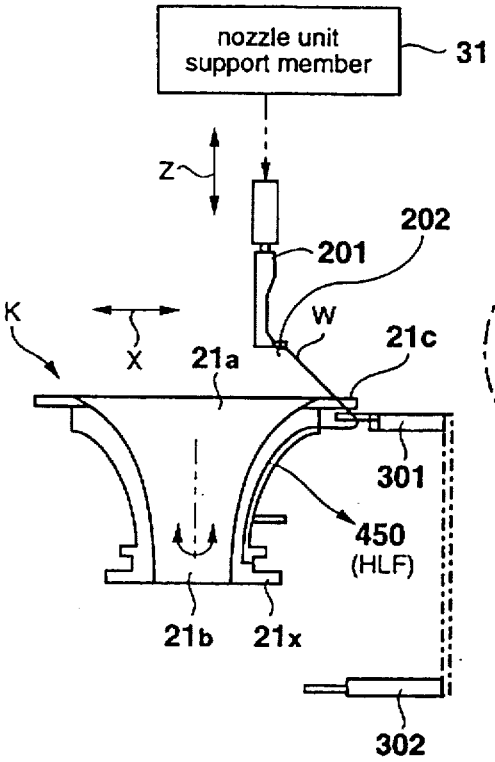
FIG. 5 is a diagram of one example showing an intermediate state of the horizontal deflection coil winding operation.
Figure 5A:
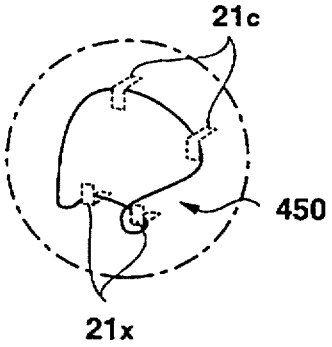

Next, as shown in FIG. 5, when the nozzle support 31 is operated, the nozzle unit 201 performs a deflection yoke winding operation in three-dimensional fashion. That is, by the movements of the nozzle unit 201 in the Z and X directions and the movements of the upper and lower guide units 301 and 302, the wire material W forms the three-dimensional first winding 450 passed around the engagement strips 21*c* and 21*x* serving as the binding sections of the workpiece K. In this case, by moving the wire material from the nozzle unit 201 in a three-dimensional direction after being bound around the engagement pieces 21*c* and 21*x*, the deflection coil 450 as the first winding is formed.

In FIG. 5, there is shown a manner in which the wire material W is bound around the engagement strip 21*c* through the cooperation with the upper guide unit 301 with the nozzle unit 201 lying above the opening 21*a* of the workpiece K. Further, where the nozzle unit 201 comes to lie below the openings 21*a* and 21*b*, it is possible to bind the wire material W around the engagement strip 21*x* through the cooperation of the lower guide unit 302 and the nozzle unit 201.

Thus, it is possible to form the so called saddle type three-dimensional first winding (deflection coil) 450.

Further, a circumferential winding 500 may be applied in the winding groove 21*d* of the workpiece K. That is, when the workpiece support 70 rotates clockwise, for example, by the operation of the rotary section 73, the wire material W extending horizontally from the top end member 202 of the nozzle unit 201 is smoothly wound along the winding groove 21*d* to form the circumferential winding 500.

Then, after the formation of the circumferential winding 500 along the winding groove 21*d*, the top end member 202 of the nozzle unit 201 moves to the engagement strip A of the workpiece K and the wire material W passes along the engagement strip A whereby the setting for the initiation of winding of the winding 501 of the leakage magnetic field shielding coil (VLF) to be described hereinbelow is complete.

Now, one example of how the deflection coil is wound saddlelike will be described in further detail with reference to FIGS. 6A through 6H.

FIGS. 6A through 6H show the steps of forming a saddle type deflection coil on the workpiece K, respectively. The top end member 202 of the nozzle unit 201 is held horizontal.

Figures 6A, 6B, 6C, 6D, 6E, 6F, 6G, 6H:
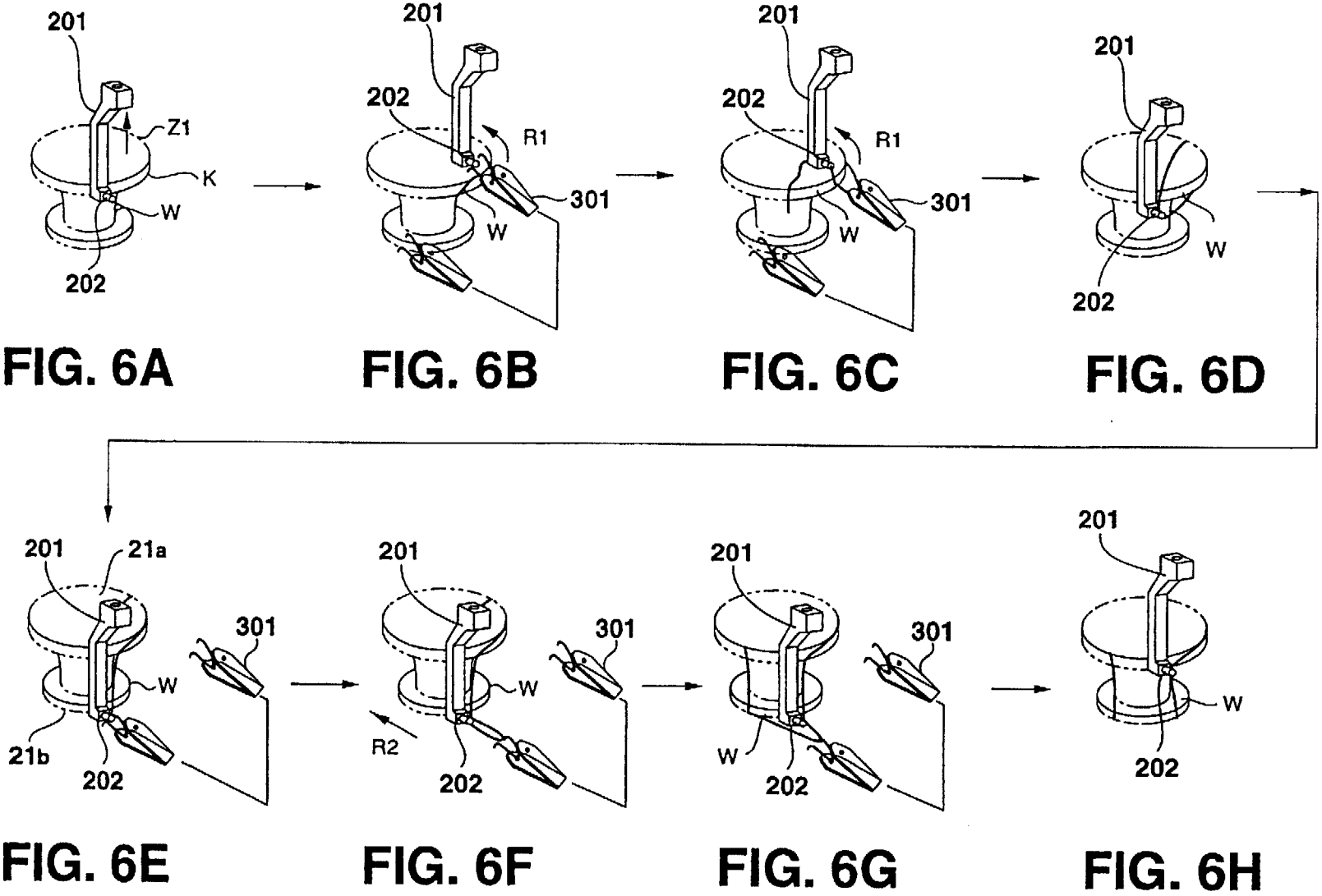
FIGS. 6A to 6H are diagrams illustrating in more detail the step of winding the horizontal deflection coil.

In FIG. 6A, the top end member 202 of the nozzle unit 201 raises up the wire material W along the direction Z1 from inside the workpiece K and in FIG. 6B, the upper guide unit 301 holds the wire material W. Then, when the workpiece K is rotated by a predetermined angle in the R1 direction, the conditions shown in FIGS. 6C and 6D are brought forth and the wire material W is wound along the circumference of the workpiece K.

Next, as shown in FIG. 6E, the nozzle unit 201 reaches the opening 21*b* through the opening 21*a* of the workpiece K and the lower guide unit 302 holds the wire material W. Then, the lower guide unit 302 draws the wire material W outside as shown in FIG. 6F and rotates the workpiece K in the direction of R2 so that the wire material W is wound circumferentially along the neck portion of the workpiece K and finally, the wire material W is wound saddlelike as shown in FIG. 6H.

Thus, the winding of the deflection coil can be wound saddlelike in a simple manner through the cooperation of the upper guide unit 301 with the lower guide unit 302.

Leakage Magnetic Field Shielding Coil (VFL) Winding Operation

In the winding operation for the leakage magnetic field shielding coil (VFL), the top end member 202 of the nozzle unit 201 moves down to a point b of the winding portion B of the leakage magnetic field shielding coil (VLF) while it supplies the wire material W. Next, the workpiece support 70 is rotated counter-clockwise (in the +θ direction) so that the top end member 202 of the nozzle unit 201 comes to lie outside a point d of the winding portion B.

Then, the top end member 202 of the nozzle unit 201 moves up in the z-direction to take a position above a point e of the winding portion B.

Further, the workpiece K rotates clockwise (−θ direction) to allow the top end member 202 to move to a position f of the winding portion B whereby the top end member 202 lowers to the initial winding position.

FIGS. 7A to 7E and FIGS. 8A to 8E show the steps of performing a leakage magnetic field shielding coil (VFL), respectively.

Figures 7A, 7B, 7C, 7D, 7E, 7F:
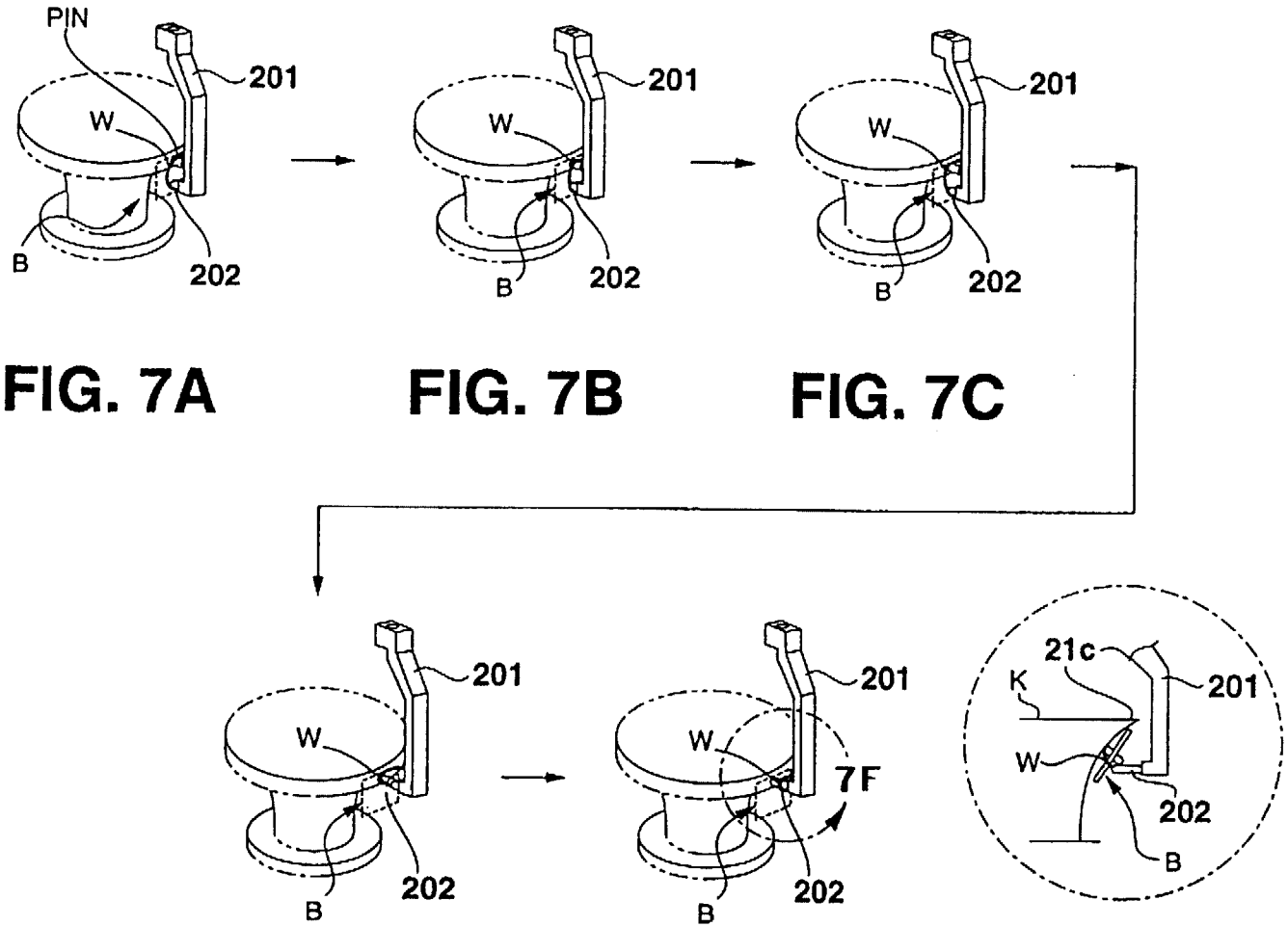
FIGS. 7A to 7E are diagrams illustrating an operation of binding one end of a wire material W around a pin before winding a leakage magnetic field shielding coil.

In FIGS. 7A through 7E, the top end member 202 of the nozzle unit 201 binds the wire material W around a pin of the VLF winding portion. That is, the top end member 202 of the nozzle unit 201 goes round the pin to wind the wire material W several times. In this case, as shown in FIG. 7E, the top end member 202 projecting horizontally from the nozzle unit 201 can come close to the pin and go round the pin so that it is possible to prevent the nozzle unit 201 from running against the engagement strip 21*c* which forms itself the outer periphery of the workpiece K.

Further, in FIGS. 8A through 8E, there is shown a manner in which the top end member 202 of the nozzle unit 201 performs a leakage magnetic field shielding coil winding operation around the VLF winding portion B.

Figures 8A, 8B, 8C, 8D, 8E, 8F:
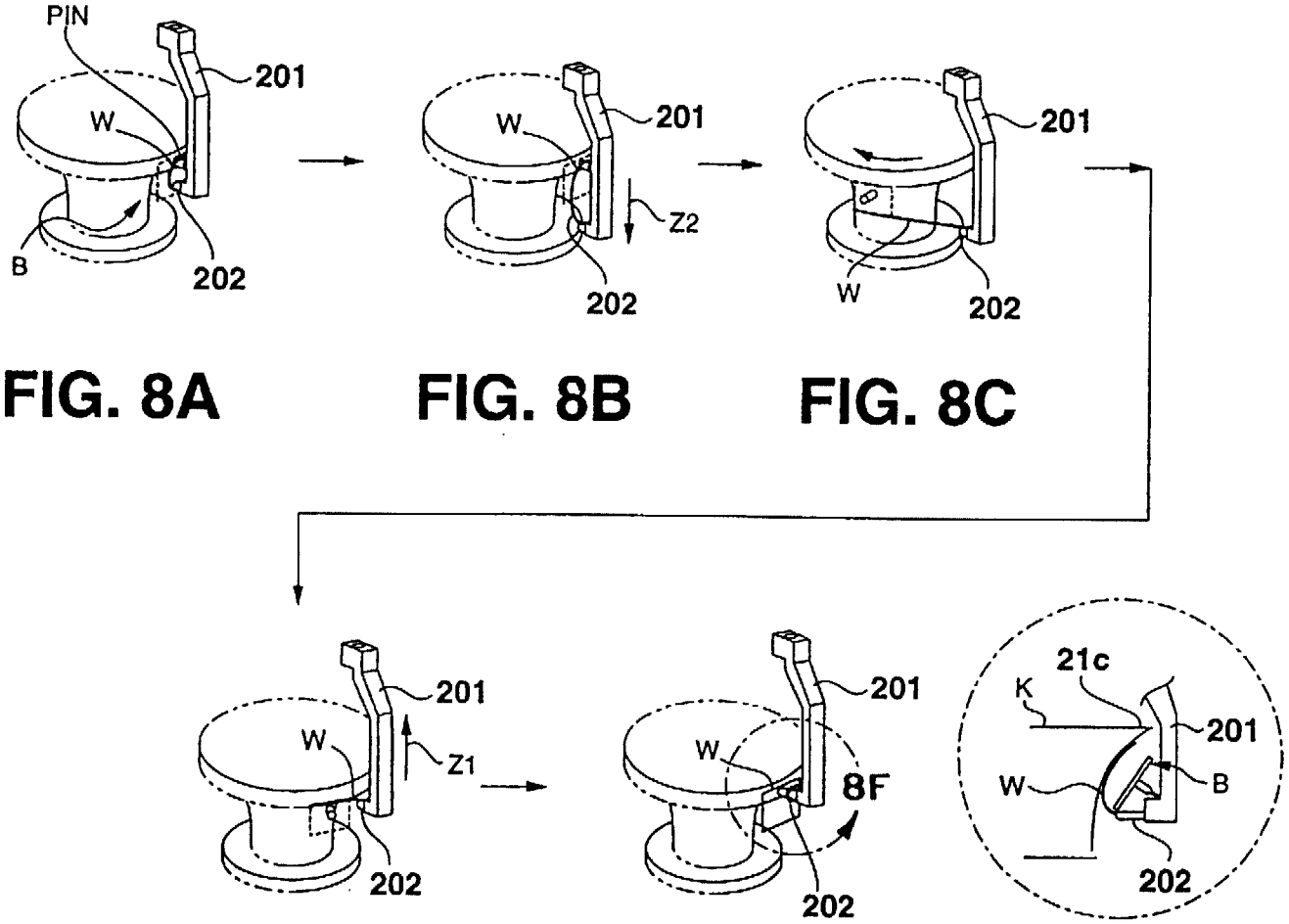
FIGS. 8A to 8E are diagrams illustrating in more detail the step of winding the leakage magnetic field shielding coil.

In FIG. 8A, the wire material W having its one end already wound around the pin of FIG. 7A is positioned at the end of the winding portion B and in FIG. 8B, the nozzle unit 201 goes down in the direction of Z2 so that the wire material W is wound over the first side of the winding portion B.

Then, as shown in FIG. 8C, the nozzle unit 201 rotates by 90 degrees and moves relative to the workpiece K so that the wire material W is wound along the groove in the second side of the winding portion.

In FIG. 8D, the nozzle unit 201 moves up in the direction of Z1 so that the wire material W is wound around the third side of the winding portion B.

Lastly, in FIG. 8E, the wire material W is wound around the fourth side of the winding portion B by the rotation of the workpiece K.

Thus, by repeating the operations in FIGS. 8A through 8E, the wire material W is wound around by a predetermined number of times.

In the above case, it is noted that as shown in FIG. 8E, when the wire material W is continuously wound around the winding portion B, since the top end member 202 is elongated to project in the horizontal direction, the nozzle unit 201 does not run against the engagement strip 21*c* of the workpiece K.

The nozzle unit 201 makes it possible that the top end member 202 binds and then wind the wire material W around the pin and the winding portion B without running against the projecting portion of the workpiece K.

As described above, as shown in FIGS. 6A to 6H, 7A to 7E and 8A to 8E, by the use of one kind of nozzle, that is, the nozzle unit 201 having the top end member 202, the horizontal deflection coil winding operation (called a main winding), the wire material binding operation with respect to the pin of FIGS. 7A to 7E and the leakage magnetic field shielding coil winding operation shown in FIGS. 8A to 8E can be performed efficiently and without causing any trouble of the nozzle unit 201 running against the workpiece K.

By repeating the above operations by a predetermined number of times, the winding of the leakage magnetic field shielding coil (VLF) is applied to the winding portion B as shown in FIG. 2 thereby completing the winding operation for the leakage magnetic field shielding coil (VFL).

As described above, in the instant embodiment, the winding of the leakage magnetic field shielding coil (VLF) becomes possible by adding the top end member 202 to the nozzle unit 201 and the winding of the VLF coil can be made continuously from the winding of the deflection coil. In this case, the workpiece K may well be held vertically by the workpiece support 70 as shown in FIG. 2. Accordingly, it is possible to perform the deflection coil and VLF coil winding operations in a short time and in a stabilized manner thereby sharply improving the production efficiency of the deflection yoke.

According to the instant embodiment, it is possible to wind the deflection yoke coil and the VLF coil efficiently and unlike the conventional method in which both the deflection coil and VLF coil winding operations are performed by a plurality of winding apparatuses, these different winding operations can be performed by a single apparatus.

Further, as shown in FIG. 2, by the provision of the excellent abrasion-resistant guide member 203 on the top end portion of the nozzle unit 201, it is possible to minimize the amount of abrasion of the top end member 202 resulting from the passage of the wire material W so that the life of the nozzle unit 201 can be extended.

However, the present invention is not limited to the above-described embodiment. In the above embodiment, the leakage magnetic field shielding coil winding operation is performed after performing the horizontal deflection coil winding but it is of course possible to reverse the order of performing the winding operations.

Figure 9:
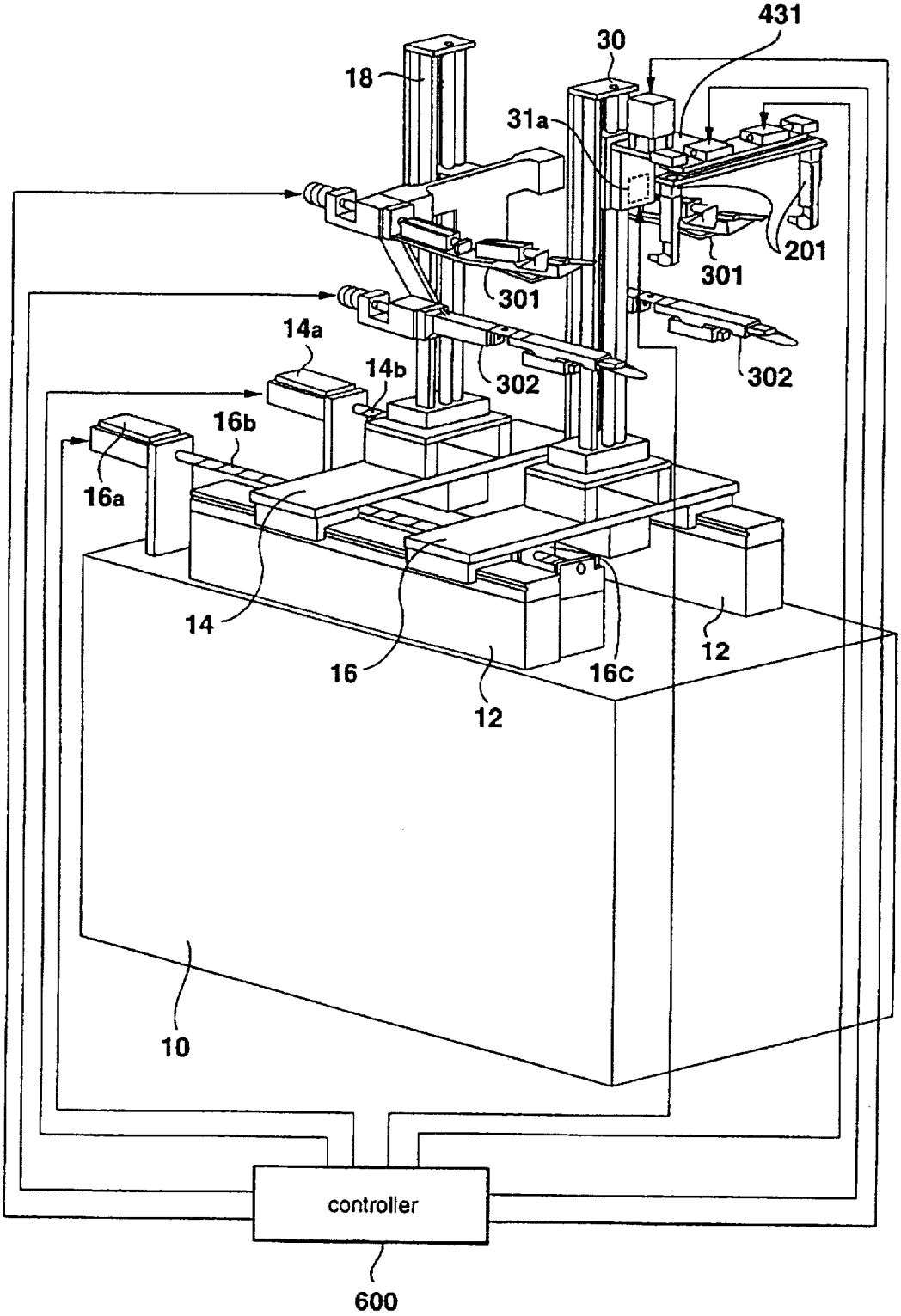
FIG. 9 is a perspective view of a winding apparatus according to another embodiment of the present invention.

Further, as another embodiment of the present invention, an example shown in FIG. 9 may be given.

As will be clear from comparison with the embodiment of FIG. 1, the winding apparatus shown in FIGS. 6A to 6H is provided with two sets of upper guide units 301 and lower guide units 302 which are provided on the strut 18 of the guide unit carrier 14.

The strut 30 of the nozzle unit carrier 16 is provided with the nozzle unit support 431. The nozzle unit support 431 is provided with two nozzle units 201. Thus, unlike the embodiment of FIG. 1, by the provision of the two nozzle units 201 and two sets of upper and lower guide units 301 and 301, it is possible to perform winding operations simultaneously on two workpieces K. The remaining points of the embodiment of FIG. 9 are similar to those of the embodiment of FIG. 9 so that the description thereof is omitted herein.

As described above, according to the present invention, it is possible to wind a wire material in different directions while the workpiece like a deflection yoke keeps its attitude in a certain state.

What is claimed is:

1. A winding apparatus for winding a wire material from a wire material supply source around a workpiece having an outer surface, which apparatus comprises:

first winding means for forming a first winding on the workpiece by moving a nozzle unit, said nozzle unit having an end through which the wire material is paid out from the wire material supply source to the workpiece and a guide unit and operating such that the wire material from the nozzle unit is bound around a binding portion of the workpiece and moved in a three-dimensional direction by the guide unit cooperating with the movement of the nozzle unit, to thereby form a first winding on the workpiece; and second winding means for forming on the workpiece a second winding different from the first winding by moving the nozzle unit in directions parallel and normal to the axis of the workpiece, said nozzle unit being maintained exterior to said outer surface of said workpiece during the formation of said second winding.

2. A winding apparatus according to claim 1, wherein said nozzle unit has a size suitable for allowing it to pass along every part of the workpiece.

3. A winding apparatus according to claim 2, wherein the end of said nozzle unit through which the wire material is introduced to said workpiece projects outward substantially in the shape of L.

4. A winding apparatus according to claim 1, wherein said first winding is a deflection coil of a deflection yoke for use with a cathode ray tube.

5. A winding method for winding a wire material paid out from a wire material supply source around a workpiece, said workpiece having an outer surface, which method is characterized in that a first winding is formed on the workpiece in such a manner that the wire material from the wire material supply source is fed to the workpiece through a nozzle unit and after being bound up around a binding portion of the workpiece, the wire material is moved in three-dimensional directions through a guide unit cooperating with the movement of the nozzle unit, and a second winding different from the first winding is formed on the workpiece by moving the nozzle unit in directions parallel and normal to the axis of the workpiece, said nozzle unit being maintained exterior to said outer surface of said workpiece during the formation of said second winding.

6. A winding method for winding a wire material paid out from a wire material supply source, which method is characterized in that a second winding is formed on a workpiece, said workpiece having an outer surface, by moving a nozzle unit, through which the wire material is fed to the workpiece, in directions parallel and normal to the axis of the workpiece, said nozzle unit being maintained exterior to said outer surface of said workpiece during the formation of said second winding, and a first winding different from the second winding is formed on the workpiece in such a manner that the wire material from the nozzle unit is moved in three-dimensional directions after is bound up around a binding portion of the workpiece, by the nozzle unit and a guide unit cooperating with the movement of the nozzle unit.

* * * * *